US008057263B1

(12) United States Patent
Howard et al.

(10) Patent No.: US 8,057,263 B1
(45) Date of Patent: Nov. 15, 2011

(54) EDGE CONNECTORS HAVING STAMPED SIGNAL CONTACTS

(75) Inventors: Edward John Howard, Millersburg, PA (US); Steven Lee Flickinger, Hummelstown, PA (US); George Irwin Peters, Jr., Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/834,349

(22) Filed: Jul. 12, 2010

(51) Int. Cl.
*H01R 24/00* (2006.01)

(52) U.S. Cl. ..... 439/631

(58) Field of Classification Search ..... 439/631, 439/260, 637, 857, 493, 495–496
See application file for complete search history.

(56) References Cited

U.S. PATENT DOCUMENTS 3,923,364 A * 12/1975 Shapiro et al. ..... 439/493
5,277,621 A * 1/1994 Seto ..... 439/493
5,584,708 A 12/1996 Leong
6,231,355 B1 5/2001 Trammel et al.
6,508,661 B1 * 1/2003 Yu ..... 439/495
6,520,797 B2 * 2/2003 Okamura et al. ..... 439/495
6,652,322 B2 * 11/2003 Ito et al. ..... 439/637
6,692,273 B1 2/2004 Korsunsky et al.
6,722,915 B1 * 4/2004 McAlonis et al. ..... 439/498
7,416,452 B1 8/2008 Sabo
7,527,511 B1 * 5/2009 Peng et al. ..... 439/260
7,553,163 B2 6/2009 McAlonis et al.

OTHER PUBLICATIONS

Tyco Electronics Standard Edge Card (SEC) II, SEC II Power, and High Current Card Edge Connectors; 114-13018, Jun. 13, 2007 Rev 8, 20 pgs.

* cited by examiner

*Primary Examiner* — Jean Duverne

(57) ABSTRACT

An electrical connector including a connector housing having opposite mating and loading faces that are configured to engage board edges of first and second circuit boards, respectively. The connector housing includes a contact channel that extends through the connector housing between the mating and loading faces. The electrical connector also includes a signal contact that is stamped from sheet material along a stamped edge. The signal contact includes a contact body having opposite sheet surfaces. The stamped edge defines a shape of the contact body that includes first and second contact fingers. The signal contact is disposed within the contact channel so that the stamped edge along the first contact finger electrically engages the first circuit board and so that the stamped edge along the second contact finger electrically engages the second circuit board.

20 Claims, 6 Drawing Sheets

EDGE CONNECTORS HAVING STAMPED SIGNAL CONTACTS

BACKGROUND OF THE INVENTION

The subject matter herein relates generally to electrical connectors, and more particularly, to board-to-board electrical connectors that are configured to communicate data signals between different circuit boards.

Various communication or computing systems use electrical connectors for transmitting data signals between circuit boards in the system. For example, conventional board-to-board connectors may include signal contacts that electrically connect contact pads of a daughter card to corresponding contact pads of a motherboard. Edge connectors are one type of board-to-board connector. Edge connectors are configured to receive an edge of the daughter card to electrically connect to the daughter card as well as hold the daughter card in a desired position. For example, edge connectors may include one or more recesses that are sized to receive a thickness of the daughter card. The daughter card includes contact pads that are located near the edge of the daughter card. When the edge of the daughter card is inserted into the recess(es), the signal contacts electrically connect with the contact pads of the daughter card. The daughter card may be held within the recess through an interference fit and/or the electrical connector may include a fastening mechanism, such as removable latches, screws, and the like, to hold the daughter card.

However, conventional edge connectors may have certain limitations. For example, it may be desirable to reduce the required space of an electrical connector within a system and/or use signal contacts that transmit at high speeds (e.g., 5-10 Gbs or higher). Reducing the required space of an electrical connector may be accomplished by reducing a centerline spacing between the signal contacts and/or reducing the size of the signal contacts. However, reducing the centerline spacing may lead to an increase in unwanted noise. Also, signal contacts of a reduced size may be unable to perform as required. Furthermore, it may be desirable for the edge connectors to include power contacts as well as signal contacts. However, power contacts may complicate the manufacturing of the electrical connectors thereby increasing the costs.

Accordingly, there is a need for edge connectors that are capable of transmitting data signals at higher speeds than known edge connectors. Furthermore, there is a need for edge connectors that have a greater density of signal contacts than known edge connectors. There is also a general need for edge connectors that are less costly to manufacture.

BRIEF DESCRIPTION OF THE INVENTION

In one embodiment, an electrical connector configured to interconnect first and second circuit boards is provided. The electrical connector includes a connector housing having opposite mating and loading faces that are configured to engage board edges of the first and second circuit boards, respectively. The connector housing includes a contact channel that extends through the connector housing between the mating and loading faces. The electrical connector also includes a signal contact that is stamped from sheet material. The signal contact includes a contact body having opposite sheet surfaces and a stamped edge extending therebetween. The stamped edge defines a shape of the contact body that includes first and second contact fingers. The signal contact is disposed within the contact channel so that the stamped edge along the first contact finger electrically connects with a contact pad of the first circuit board and so that the stamped edge along the second contact finger electrically connects with a contact pad of the second circuit board.

In another embodiment, an electrical connector configured to interconnect first and second circuit boards is provided. The electrical connector includes a connector housing having opposite mating and loading faces that are configured to engage board edges of the first and second circuit boards, respectively. The connector housing includes a contact channel that extends through the connector housing between the mating and loading faces. The electrical connector also includes a signal contact stamped from sheet material. The signal contact includes a contact body having opposite sheet surfaces and a stamped edge extending therebetween. The opposite sheet surfaces extend parallel to a body plane substantially throughout the contact body. The contact body includes a base portion and first and second contact fingers that extend from the base portion in substantially opposite directions. The connector housing is configured to hold the base portion within the contact channel and the first and second contact fingers are configured to flex relative to the base portion and within the body plane when the first and second contact fingers engage the first and second circuit boards, respectively.

DETAILED DESCRIPTION OF THE INVENTION

Figure 1:
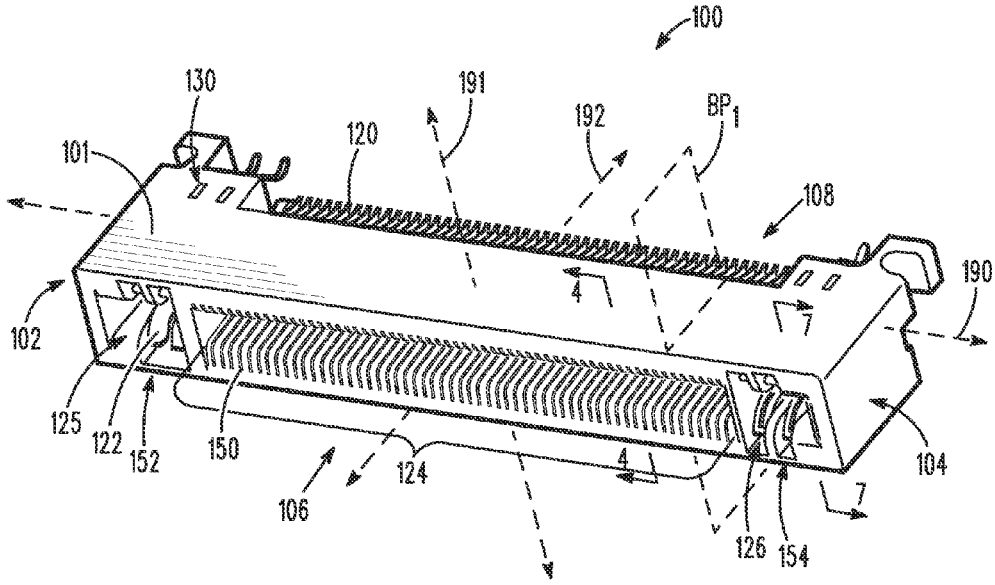
FIG. 1 is a perspective view of a mating face of an electrical connector formed in accordance with one embodiment.
Figure 2:
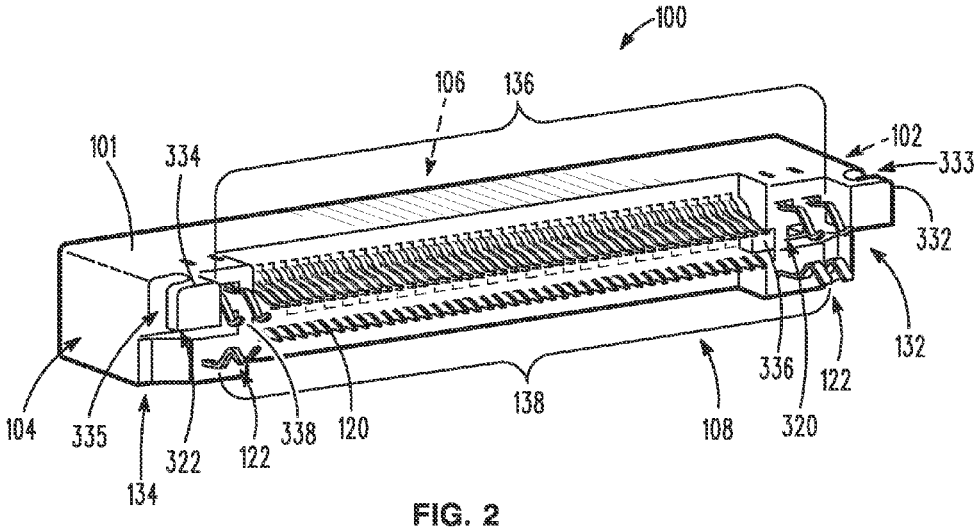
FIG. 2 is a perspective view of a loading face of the electrical connector of FIG. 1.

FIGS. 1 and 2 are front and rear perspective views of an electrical connector 100 formed in accordance with one embodiment. The electrical connector 100 includes an elongated connector housing 101 that extends between a pair of opposite housing sides 102 and 104 and opposite mating and loading faces 106 and 108. The mating and loading faces 106 and 108 extend along a lateral axis 190 (FIG. 1) that extends between the opposite housing sides 102 and 104. The housing sides 102 and 104 extend along a central longitudinal axis 192 (FIG. 1) that extends between the mating and loading faces 106 and 108. The electrical connector 100 is also oriented with respect to a vertical axis 191 (FIG. 1). The mating and loading faces 106 and 108 are configured to engage respective circuit boards 116 and 118 (shown in FIG. 6).

In the illustrated embodiment, the electrical connector 100 is an edge connector that holds the circuit boards 116 and 118 in a substantially coplanar relationship. As such, the electrical connector 100 may also be referred to as edge-to-edge or straddle-mount connector. However, in alternative embodiments, the circuit boards 116 and 118 may be held by the electrical connector 100 in different positional relationships, such as at a right-angle relationship, an orthogonal relationship, or in a stacked relationship where the circuit boards 116 and 118 extend parallel to each other. Also, the circuit boards 116 and 118 may be held in a stair-like manner where the circuit boards 116 and 118 extend along separate parallel planes and may or may not at least partially overlap each other.

The connector housing 101 is configured to receive and hold electrical contacts for electrically connecting the circuit boards 116 and 118 to each other. For example, the electrical connector 100 may include signal contacts 120 that are disposed within the connector housing 101 and are configured to transmit data signals. In some embodiments, the signal contacts 120 are configured to transmit high-speed data signals, such as data signals greater than about 5 gigabits/second (Gbs) or, more particularly, data signals greater than about 10 Gbs. Furthermore, the signal contacts 120 may be stamped from sheet material and positioned so that a stamped edge of the signal contact 120 engages both of the circuit boards 116 and 118. In such embodiments, the signal contacts 120 may permit a centerline spacing that is smaller than a centerline spacing of other known electrical connectors, which may use profiled-and-formed signal contacts unlike solely profiled signal contacts like those described with respect to the illustrated embodiment. For example, the signal contacts 120 may be stamped from sheet material having a thickness of less than about 0.010 inches. In particular embodiments, the sheet material may be about 0.008 inches. In more particular embodiments, the sheet material may be less than about 0.005 inches or less than about 0.002 inches. However, the signal contacts 120 may be stamped from sheet material having a thickness greater than about 0.010 inches. Furthermore, as will be described in greater detail below, the signal contacts 120 may include contact fingers that engage the circuit boards 116 and 118 and that move within a common body plane $BP_1$ (FIG. 1) that extends along the longitudinal and vertical axes 192 and 191.

Furthermore, the electrical connector 100 may include power contacts 122 disposed within the connector housing 101 and that are configured to transmit power between the circuit boards 116 and 118. For example, the power contacts 122 may be configured to transmit greater than about 6 amperes (A) or, more particularly, greater than about 10 A. In particular embodiments, the connector housing 101 has tool indentations 130 where a stake, or other similar tool, has pressed material of the connector housing 101 into the power contacts 122 to facilitate holding the power contacts 122 therein. The material may be deformed to surround the power contacts 122. Such processes may be referred to as cold-staking processes.

As shown in FIG. 1, the connector housing 101 may include contact channels 150 that extend axially (i.e., along the longitudinal axis 192) through the connector housing 101 between the mating and loading faces 106 and 108. The contact channels 150 are configured to hold the signal contacts 120. The connector housing 101 may also include contact cavities 152 and 154 that extend axially through the connector housing 101 between the mating and loading faces 106 and 108. The contact cavities 152 and 154 are configured to hold the power contacts 122. In the illustrated embodiment, the contact channels 150 are located between the contact cavities 152 and 154. However, the contact channels 150 and the contact cavities 152 and 154 may have other positional relationships in alternative embodiments.

Also shown in FIG. 1, the connector housing 101 includes board-receiving recesses 124-126 along the mating face 106 that are shaped to receive portions of the circuit board 116. When inserted into the board-receiving recesses 124-126, the circuit board 116 may electrically connect with the signal and power contacts 120 and 122. Furthermore, the board-receiving recesses 124-126 may facilitate holding the circuit board 116 in a desired position.

As shown in FIG. 2, the connector housing 101 may also include attachment structures 132 and 134 that are configured to engage portions of the circuit board 118 to secure the circuit board 118 thereto. The attachment structures 132 and 134 may also house corresponding power contacts 122. By way of example, the attachment structures 132 and 134 may include mounting features 332 and 334 that extend in a direction along the longitudinal axis 192 (FIG. 1). The mounting features 332 and 334 are configured to be mounted onto the circuit board 118 and coupled thereto. The mounting features 332 and 334 may have passages 333 and 335, respectively, that extend along the vertical axis 191 (FIG. 1) and are configured to receive corresponding fasteners, such as threaded fasteners, plugs, pins, and the like. In the illustrated embodiment, the passages 333 and 335 open onto the housing sides 102 and 104, respectively. However, in alternative embodiments, the passages 333 and 335 may open to the loading face 108 or be completely surrounded and defined by the material of the connector housing 101.

Also shown in FIG. 2, the attachment structures 132 and 134 include board slots 320 and 322 that are sized and shaped to receive portions of the circuit board 118 and also alignment features 336 and 338 that are configured to facilitate aligning the circuit board 118 when the circuit board 118 engages the loading face 108. The board slot 320 may extend from the alignment feature 336 toward the housing side 102, and the board slot 322 may extend from the alignment feature 338 toward the housing side 104. Also shown in FIG. 2, the power and signal contacts 122 and 120 may form opposing rows 136 and 138. The rows 136 and 138 may extend in a direction along the lateral axis 190 (FIG. 1) between the housing sides 102 and 104. The rows 136 and 138 may define a board-receiving region 140 (shown in FIG. 5) that is configured to receive the circuit board 118.

In some embodiments, the connector housing 101 comprises a single piece of material that includes the features described herein with respect to the connector housing 101. For example, the connector housing 101 may comprise an insulative material that has been formed into shape by an injection molding process. In such embodiments, the electrical contacts may be held by the connector housing 101 through interference fits and/or cold-stake processing. In particular embodiments, the signal contacts 120 are held by the connector housing 101 through interference fits, and the power contacts 122 are held through a cold-staking process.

In the illustrated embodiment, the electrical connector 100 includes only two types of electrical contacts, the signal contacts 120 and the power contacts 122. However, in alternative embodiments, the electrical connector 100 may include additional types of signal contacts that are manufactured in different manners and/or have different shapes than the signal contacts 120. The electrical connector 100 may also include additional power contacts that are manufactured in different manners and/or have different shapes than the power contacts 122. Furthermore, in the illustrated embodiment, the electrical connector 100 includes a plurality of signal contacts 120 and a plurality of power contacts 122. In some embodiments, the electrical connector 100 may include only a single signal contact 120 and/or only a single power contact 122.

Figure 3:
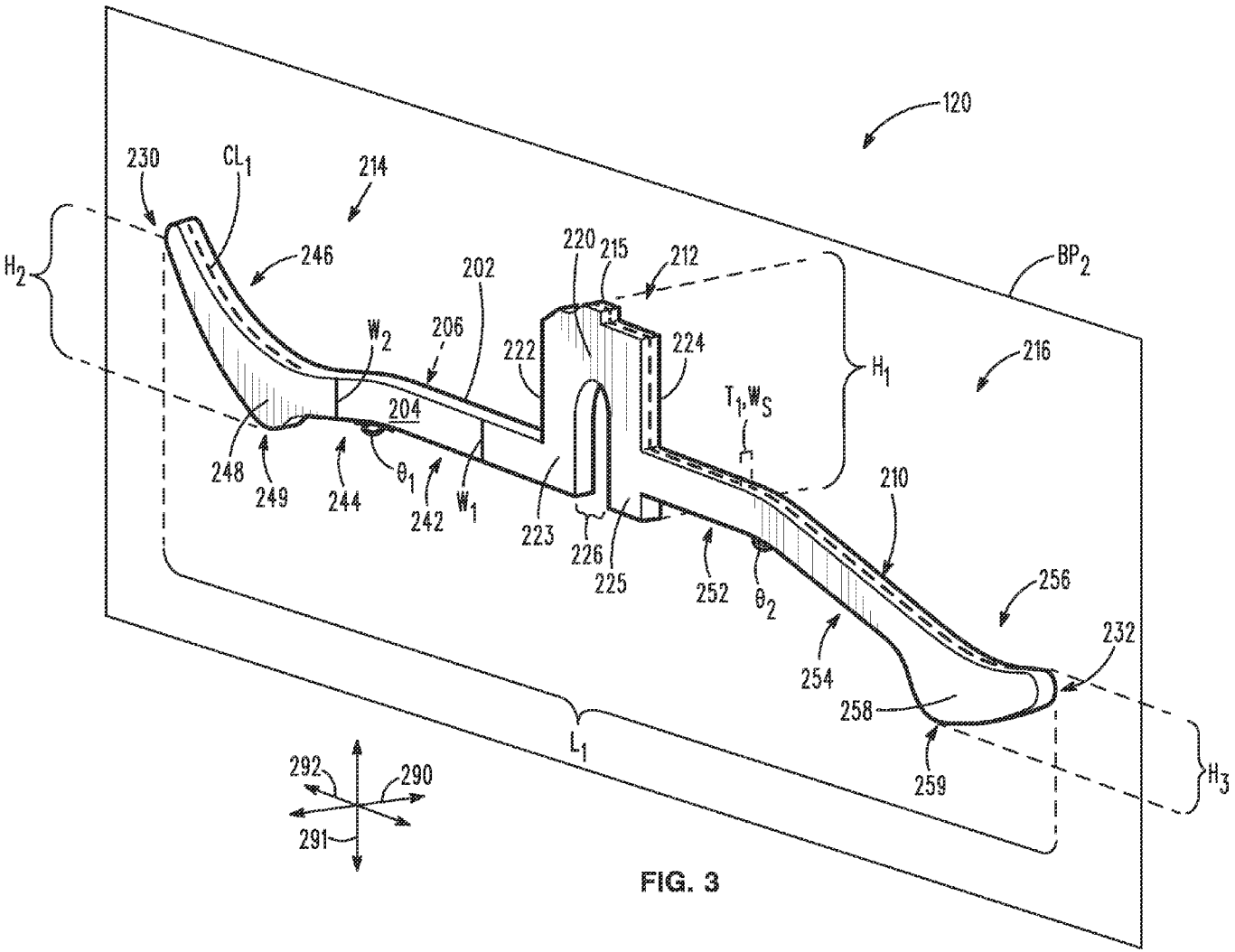
FIG. 3 is an isolated perspective view of a signal contact formed in accordance with one embodiment.

FIG. 3 is a perspective view of the signal contact 120 formed in accordance with one embodiment. The signal contact 120 is oriented with respect to a longitudinal axis 292, a lateral axis 290, and a vertical axis 291. The signal contact 120 may be stamped from sheet material, such as a copper alloy. In particular embodiments, the signal contact 120 is only stamped from sheet material and, as such, may comprise a single piece of material. For example, the signal contact 120 may not be subsequently bent or deformed to a particular shape. Instead, the signal contact 120 may be ready for insertion into the connector housing 101 (FIG. 1) after being stamped from the sheet material. However, in alternative embodiments, the signal contact 120 may be bent, shaped, or somehow formed after the stamping operation.

As shown, the signal contact 120 includes a contact body 202 having opposite sheet surfaces 204 and 206 and a stamped edge 210 that extends between the sheet surfaces 204 and 206. The sheet surfaces 204 and 206 may extend parallel to each other and also extend parallel to and define a body plane $BP_2$. The body plane $BP_2$ extends parallel to the longitudinal and vertical axes 292 and 291. In the illustrated embodiment, the stamped edge 210 defines a shape or contour of the contact body 202. As such, the stamped edge 210 may extend along a path that substantially coincides with the body plane $BP_2$. For example, a centerline $CL_1$ (indicated by a dashed line) that extends along a center of the stamped edge 210 between the sheet surfaces 204 and 206 may extend within the body plane $BP_2$. More specifically, a path made by the centerline $CL_1$ may essentially only exist in the board plane $BP_2$.

The stamped edge 210 may be formed when a tool or cutting device (not shown) stamps the contact body 202 from a sheet of material. The tool or cutting device may be configured to stamp the sheet material so that the signal contact 120 includes predetermined features. For example, the stamped edge 210 may define a base portion 212 and first and second contact lingers 214 and 216. The contact fingers 214 and 216 extend from the base portion 212 in generally opposite directions away from each other and along the longitudinal axis 292. In particular embodiments, the first contact finger 214 may be a leading contact finger that is first inserted into the connector housing 101, and the second contact finger may be a trailing contact finger that is not inserted through the connector housing 101.

The base portion 212 is shaped relative to the contact channel 150 (FIG. 1) so that the connector housing 101 and the base portion 212 may form an interference fit therewith. As shown, the base portion 212 may include a center region 220 and first and second arms 222 and 224 that are joined by the center region 220. In addition, the base portion 212 may include a grip member 215 that projects away from the center region 220. The arms 222 and 224 may extend substantially parallel to one another and have a spacing 226 therebetween. Accordingly, in particular embodiments, the base portion 212 may be substantially C-shaped or U-shaped. However, in alternative embodiments, the base portion 212 does not include a spacing 226. Also shown, the arms 222 and 224 may extend to corresponding joint portions 223 and 225 where the contact fingers 214 and 216 couple to the arms 222 and 224, respectively. As shown, the contact fingers 214 and 216 may couple to the arms 222 and 224 near ends of the arms 222 and 224. Also shown, the base portion 212 may have a vertical distance or height $H_1$ measured between the stamped edge 210 along the grip member 215 and the stamped edge 210 along a bottom of the base portion 212.

The contact finger 214 may include a leading end 230 of the contact body 202, and the contact finger 216 may include a trailing end 232 of the contact body 202. A length $L_1$ of the contact body 202 may extend between the leading and trailing ends 230 and 232 along the longitudinal axis 292. The contact finger 214 may be shaped to include a longitudinal portion 242 that extends from the arm 222 and an intermediate portion 244 that extends from the longitudinal portion 242 toward the leading end 230. The longitudinal portion 242 may extend in a direction along the longitudinal axis 292, and the intermediate portion 244 may extend in a linear manner from the longitudinal portion 242. As shown, the longitudinal and intermediate portions 242 and 244 may extend in slightly different directions such that the longitudinal and intermediate portions 242 and 244 form an angle $\theta_1$ between each other. The angle $\theta_1$ may be less than 180°.

Figure 6:
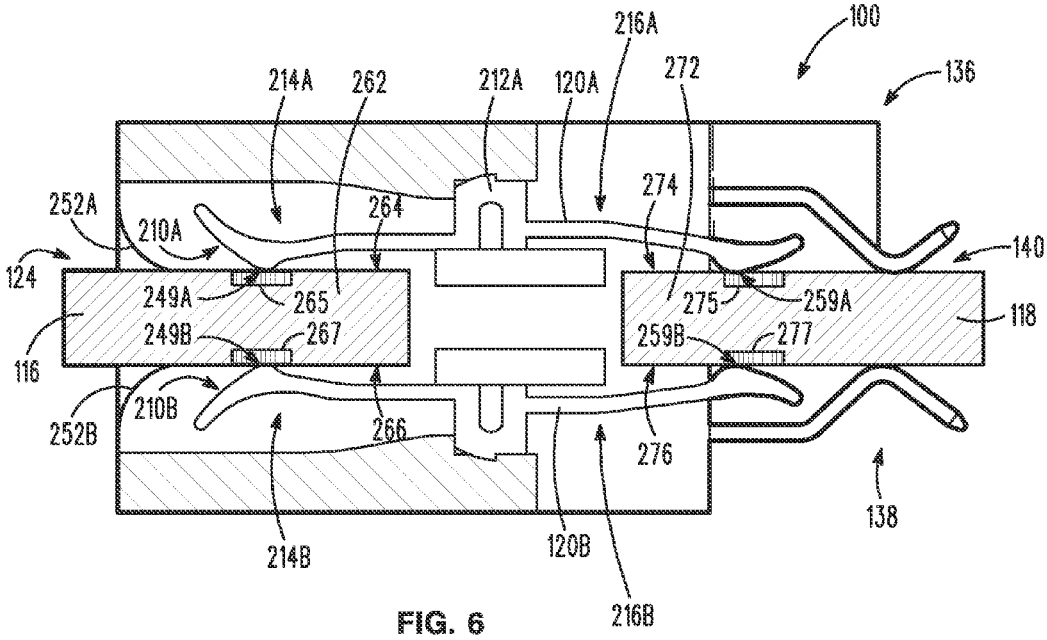
FIG. 6 illustrates different circuit boards being electrically interconnected by the electrical connector of FIG. 1.

The contact finger 214 also includes a distal portion 246 having a protrusion 248. The protrusion 248 is configured to electrically connect (i.e., make electrical contact with) to the circuit board 116 (FIG. 6). The protrusion 248 may include an edge-interface area 249 along the stamped edge 210 that is configured to directly contact the circuit board 116. Also shown, the distal portion 246 may have a contour that facilitates insertion into the corresponding contact channel 150 (FIG. 1). For example, the distal portion 246 may curve away from the protrusion 248 and extend toward the leading end 230. The leading end 230 and the protrusion 248 define a vertical dimension or height $H_2$, which may be configured to facilitate inserting the signal contact 120 into the connector housing 101 (FIG. 1).

Likewise, the contact finger 216 may be shaped to include a longitudinal portion 252 that extends from the arm 224 and an intermediate portion 254 that extends from the longitudinal portion 252. The longitudinal portion 252 may extend in a direction along the longitudinal axis 292, and the intermediate portion 254 may extend in a linear manner from the longitudinal portion 252. As shown, the longitudinal and intermediate portions 252 and 254 may extend in slightly different directions such that the longitudinal and intermediate portions 252 and 254 form an angle $\theta_2$ between each other. The angle $\theta_2$ may be less than 180°. In the illustrated embodiment, the angle $\theta_2$ is less than the angle $\theta_1$.

The contact finger 216 also includes a distal portion 256 having a protrusion 258 that is configured to electrically connect to the circuit board 118 (FIG. 6). The protrusion 258 may include an edge-interface area 259 along the stamped edge 210 that is configured to directly contact the circuit board 118. The distal portion 256 may curve away from the protrusion 258 and extend toward the trailing end 232. The trailing end 232 and the protrusion 258 define a vertical dimension or height $H_3$ which may be smaller than the height $H_2$ of the contact finger 214.

In the illustrated embodiment, the contact body 202 comprises a substantially planar structure. For example, the contact body 202 may have a thickness $T_1$ that extends between the sheet surfaces 204 and 206. As such, the thickness $T_1$ may represent a width $W_s$ of the stamped edge 210. The thickness $T_1$ may be substantially uniform throughout the contact body 202. The thickness $T_1$ may have values similar to the thickness of sheet material described above. For example, the thickness $T_1$ may be less than about 0.010 inches, about 0.008 inches, or less than about 0.002 inches. As described above, the sheet surfaces 204 and 206 may extend substantially parallel to each other and define the body plane $BP_2$. Furthermore, in the illustrated embodiment, the thickness $T_1$ is generally smaller than a dimension of the sheet surface 204 or the sheet surface 206. For example, the thickness $T_1$ is smaller than a width $W_1$ of the longitudinal portion 242 or a width $W_2$ of the intermediate portion 244. As such, the contact fingers 214 and 216 may provide greater resistance against deflection.

Figure 4:
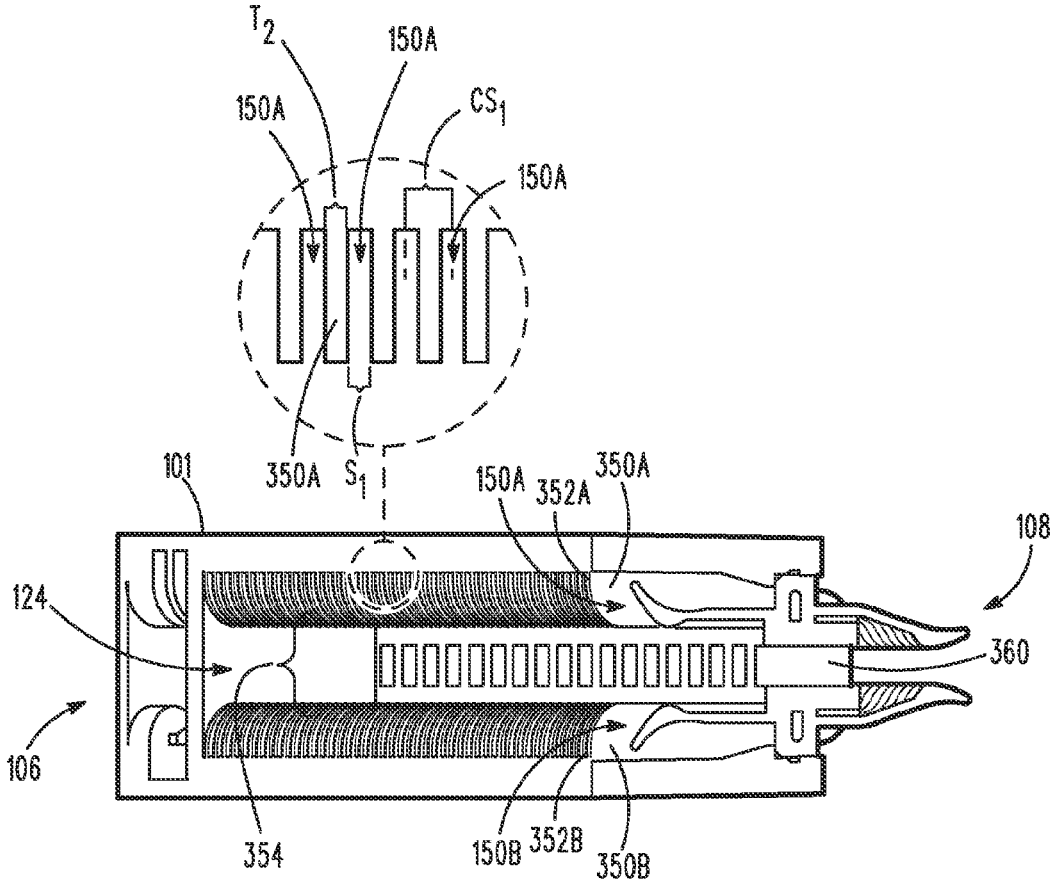
FIG. 4 is a perspective view of a cross-section of the electrical connector shown in FIG. 1.

FIG. 4 is a perspective view of a cross-section of the electrical connector 100 taken along the line 4-4 in FIG. 1. The connector housing 101 may include a plurality of opposing sidewalls 350A and 350B. Adjacent sidewalls 350A may be separated laterally from one another by the contact channels 150A, and adjacent sidewalls 3508 may be separated laterally from one another by the contact channels 150B. As shown, the sidewalls 350A and 350B may include wall edges 352A and 352B that define a shape of the corresponding sidewalls 350A and 350B. The wall edges 352A and 352B may extend toward each other and then curve and extend along the longitudinal axis 192 (FIG. 1) toward an inner structure 360 that is located between the mating and loading faces 106 and 108. The inner structure 360 extends along the lateral axis 190 (FIG. 1) between the housing sides 102 and 104 (FIG. 1) and supports the sidewalls 350A and 350B. The wall edges 352A and 3523 are separated by a gap 354 that is sized and shaped to receive and hold the circuit board 116 (FIG. 6). Accordingly, the board-receiving recess 124 may be at least partially defined by the wall edges 352A and 352B and the inner structure 360.

As shown in the cut-out portion of FIG. 4, adjacent contact channels 150A are separated by a corresponding sidewall 350A. The sidewall 350A has a wall thickness $T_2$ measured along the lateral axis 190 and the contact channels 150A have a channel spacing $S_1$ measured along the lateral axis 190. In some embodiments, the channel spacings $S_1$ are about equal to or less than the wall thicknesses $T_2$. In particular embodiments, as shown in FIG. 4, the channel spacings $S_1$ are less than the wall thicknesses $T_2$. Such embodiments may have a reduced centerline spacing $CS_1$ between the signal contacts 120 as compared to known electrical connectors. By way of example only, the centerline spacing $CS_1$ may be less than about 1 mm. In more particular embodiments, the centerline spacing $CS_1$ may be about 0.8 mm or less than about 0.8 mm. However, in alternative embodiments, the channel spacings $S_1$ are greater than the wall thicknesses $T_2$.

Figure 5:
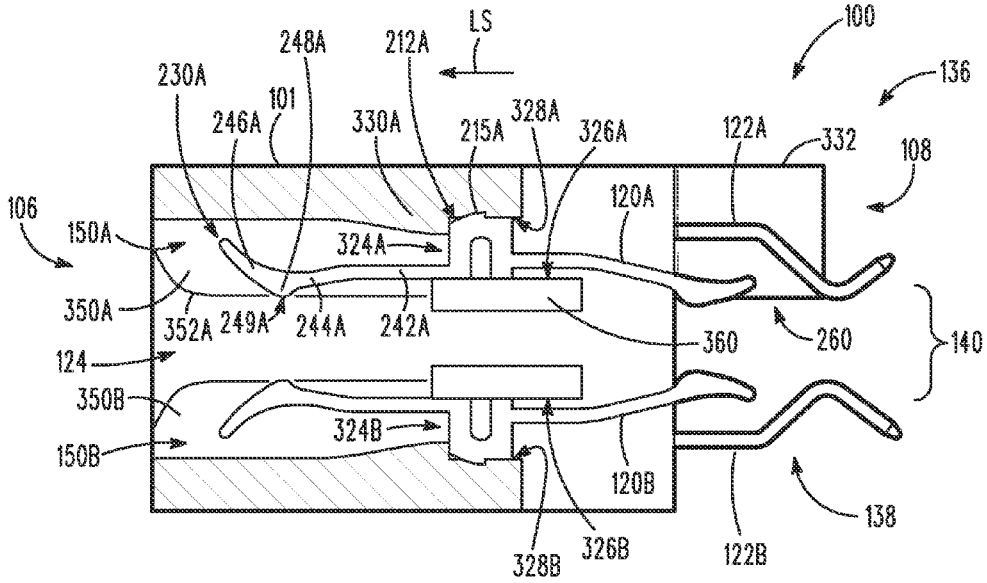
FIG. 5 shows a cross-section of the electrical connector of FIG. 1 to illustrate the signal contacts held by the electrical connector.

FIG. 5 illustrates a plan view of the cross-section of the electrical connector 100 shown in FIG. 4. The inner structure 360 includes opposite facing interior surfaces 326A and 326B. The connector housing 101 may also include interior surfaces 328A and 328B that oppose the interior surfaces 326A and 326B, respectively. As shown, the contact channels 150A and 150B may include contact-insertion spaces 324A and 324B, respectively. The contact-insertion space 324A is defined by adjacent sidewalls 350A and the interior surfaces 326A and 328A. The contact-insertion space 324B is defined by adjacent sidewalls 350B and the interior surfaces 326B and 328B.

Although the following description is with specific reference to the contact channel 150A, the description may also be applicable to the contact channel 150B. The contact-insertion space 324A of the contact channel 150A may be sized to permit the signal contact 120A to be inserted into the contact channel 150A and form an interference fit with the connector housing 101. For example, when assembling the electrical connector 100, the leading end 230A of each signal contact 120A may approach the contact-insertion space 324A from the loading face 108. More specifically, the signal contact 120A may be advanced in a substantially linear manner toward the mating face 106 in a loading direction LS (indicated by the arrow) that extends from the loading face 108 to the mating face 106. In some embodiments, the distal portion 246A may move through the contact-insertion space 324A without being obstructed or deflected by the connector housing 101 (e.g., the interior surfaces 326A and 328A). However, in the exemplary embodiment, the signal contact 120A may approach the contact-insertion space 324A at a slight angle to permit the distal portion 246A to move between the interior surfaces 326A and 328A.

After the distal portion 246A clears the contact-insertion space 324A, the intermediate and longitudinal portions 244A and 242A also move therethrough until the base portion 212A is received within the contact-insertion space 324A. When the base portion 212A moves into the contact-insertion space 324A, the base portion 212A may form an interference fit with the opposing interior surfaces 326A and 328A. For example, the base portion 212A may be compressed between the interior surfaces 326A and 328A. The grip member 215A may facilitate preventing the signal contact 120A from being removed from the contact channel 150A. As shown, the connector housing 101 may also include a shoulder 330A that provides a positive stop to prevent the base portion 212A from moving further through the contact channel 150A when inserted. When the electrical connector 100 is fully assembled, the protrusion 248A may clear the wall edge 352A so that the edge-interface area 249A is located within the board-receiving recess 124. However, in alternative embodiments, the edge-interface area 249A may not clear the wall edge 352A and, instead, may be disposed between the adjacent sidewalls 350A.

Also shown in FIG. 5, the signal contacts 120A and the power contacts 122A may form the row 136 of contacts. The signal contacts 120B and the power contacts 122B may form the row 138 of contacts. The opposing rows 136 and 138 may be spaced apart from each other along the loading face 108 in order to form a board-receiving region 140. The mounting feature 332 may have a mounting surface 260 configured to interface with the circuit board 118. (Although not shown, the mounting structure 334 (FIG. 2) may also have a mounting surface.)

FIG. 6 illustrates the plan view of the cross-section of the electrical connector 100 shown in FIG. 5 after the circuit board 116 has been inserted into the board-receiving recesses 124-126 (only the board-receiving recess 124 is shown in FIG. 6) and the circuit board 118 has been inserted into the board-receiving region 140 between the opposing rows 136 and 138 of contacts. More specifically, FIG. 6 illustrates a board-edge section 262 of the circuit board 116 that includes opposite board surfaces 264 and 266 having respective contacts pads 265 and 267. In the illustrated embodiment, the contact pads 265 and 267 are substantially flush with the corresponding board surfaces 264 and 266. However, in other embodiments, the contact pads 265 and 267 may clear and protrude beyond the board surfaces 264 and 266 or, alternatively, may be embedded a depth within the circuit board 116. Likewise, the circuit board 118 may include a board-edge section 272 that includes opposite board surfaces 274 and 276 having respective contacts pads 275 and 277. In the illustrated embodiment, the contact pads 275 and 277 are substantially flush with the corresponding board surfaces 274 and 276, but other contact pads may be used as described above.

When the circuit board 116 is advanced into the board-receiving recess 124 in a direction along the longitudinal axis 192 (FIG. 1), the circuit board 116 slides between the contact fingers 214A and 214B of the signal contacts 120A and 120B. The wall edges 252A and 252B are shaped to facilitate receiving and directing the board-edge section 262 into the board-receiving recess 124. As the circuit board 116 slides therealong, the stamped edges 210A and 210B engage the circuit board 116 thereby deflecting the contact fingers 214A and 2148 away from the circuit board 116. The contact fingers 214A and 214B may move within the body plane $BP_2$ (FIG. 3) that also extends along the longitudinal axis 192 (FIG. 1). More specifically, the contact fingers 214A and 214B are configured to flex within the body plane $BP_2$. In some embodiments, the contact fingers 214A and 214B do not move transverse to the body plane $BP_2$ (i.e., the contact fingers 214A and 214B do not move in and out of the body plane $BP_2$). Furthermore, the stamped edges 210A and 210B are configured to slide along the board surfaces 264 and 266, respectively. The edge-interface areas 249A and 249B of the contact fingers 214A and 214B slide along the board surfaces 264 and 266, respectively, until the edge-interface areas 249A and 249B electrically connect with the contact pads 265 and 267, respectively.

When the circuit board 118 is advanced into the board-receiving region 140 in a direction along the longitudinal axis 192, the circuit board 118 slides between the signal contacts 120A and 120B. As the circuit board 118 slides therealong, the stamped edges 210A and 210B engage the circuit board 118 thereby deflecting the contact fingers 216A and 216B away from the circuit board 118 in opposite directions. Similar to the contact fingers 214A and 214B, the contact fingers 216A and 216B may move within the body plane $BP_2$. The stamped edges 210A and 210B slide along the board surfaces 274 and 276, respectively. The edge-interface areas 259A and 259B slide along the board surfaces 274 and 276, respectively, until the edge-interface areas 259A and 25913 electrically connect with the contact pads 275 and 277, respectively. In some embodiments, the edge-interface areas 259A and 259B may then be soldered to the corresponding contact pads 275 and 277. Accordingly, the contact fingers 214 and 216 of one signal contact 120 may move in a common direction when engaged by the respective circuit boards 116 and 118. For example, when the circuit boards 116 and 118 engage the signal contact 120A, the contact fingers 214A and 216A are configured to independently flex in a common direction within the body plane $BP_2$ with respect to the base portion 212A. Unlike other, known electrical connectors, the stamped edge 210A electrically connects with both circuit boards 116 and 118 through the edge-interface areas 249A and 259A.

Figure 7:
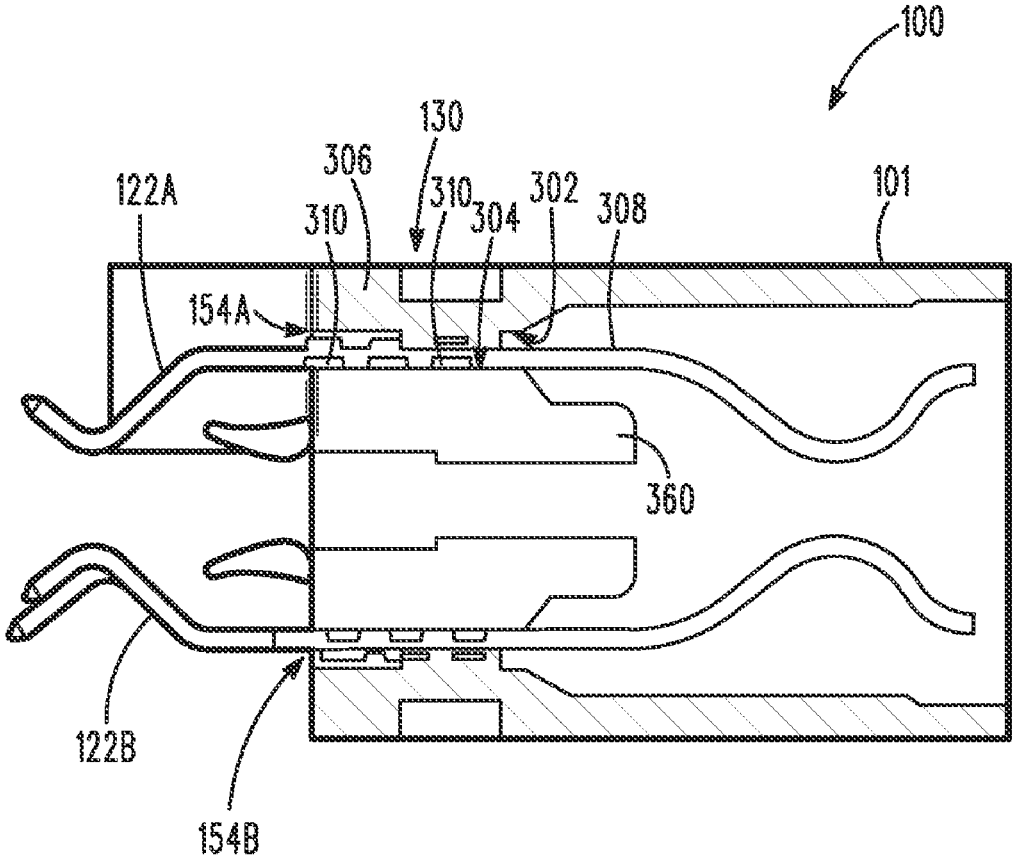
FIG. 7 shows another cross-section of the electrical connector of FIG. 1 to illustrate the power contacts held by the electrical connector.

FIG. 7 shows a cross-section of the electrical connector 100 taken along the line 7-7 shown in FIG. 1. As shown, the power contacts 122A and 122B are disposed within corresponding contact cavities 154A and 154B, respectively. Although the following description is with specific reference to the contact cavity 154A, the description may also be applied to the contact cavity 154B. The power contact 122A includes a contact body 308 having one or more coupling projections 310 that extend from the contact body 308. The contact body 308 may be stamped and formed from a sheet of material. The contact cavity 154A is defined by an interior surface 302 of the inner structure 360 and an interior surface 304 of a cavity wall 306. After the connector housing 101 is formed, the power contact 122A may be inserted into the contact cavity IMA.

The power contact 122A may be coupled to the connector housing 101 through a cold-staking process. When the material of the connector housing 101 is not fully set, a tool (not shown) may press the cavity wall 306 toward the power contact 122A thereby forming the tool indentations 130. When the cavity wall 306 is pressed, the material of the cavity wall 306 is deformed and surrounds the coupling projections 310 of the contact body 308. The material of the connector housing 101 may then set into a final shape. As such, the material surrounding the coupling projections 310 prevents the power contact 122A from being removed from the connector housing 101.

Figure 8:
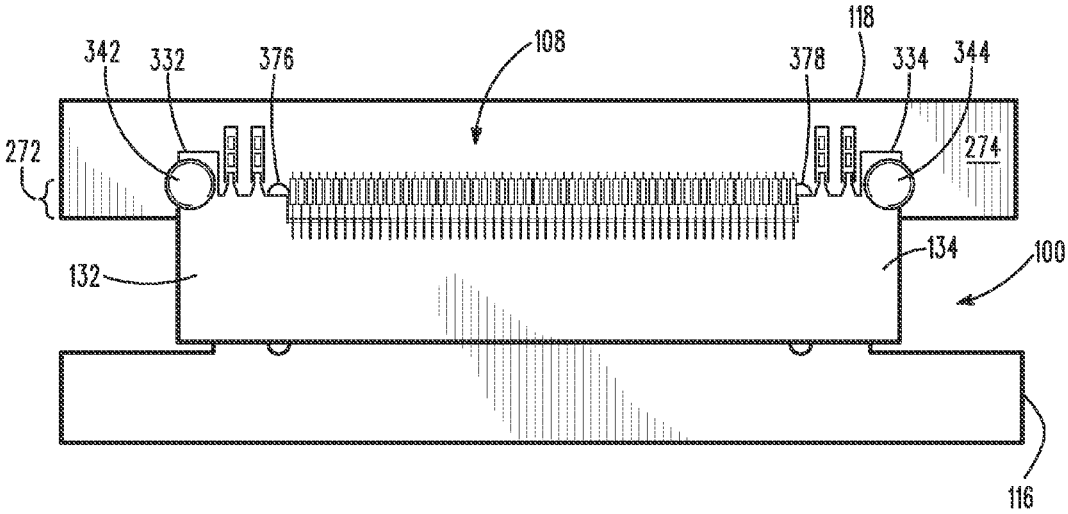
FIG. 8 is a top plan view of the electrical connector of FIG. 1 engaged to different circuit boards.
Figure 9:
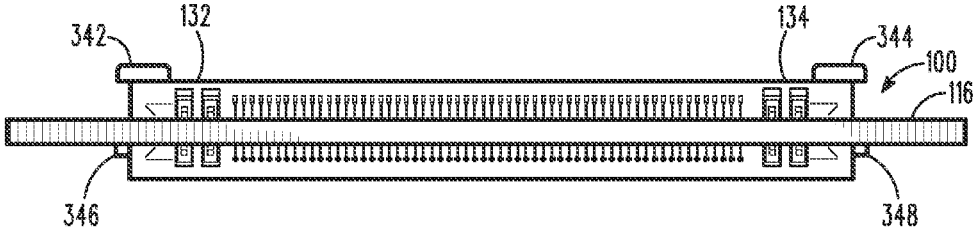
FIG. 9 is a front view of the electrical connector of FIG. 1 engaged to different circuit boards.
Figure 10:
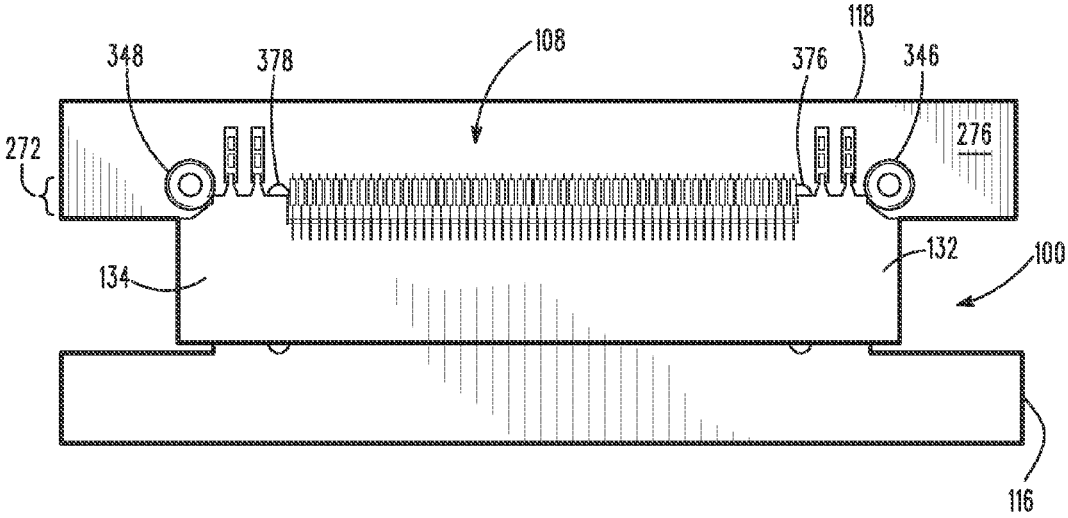
FIG. 10 is a bottom view of the electrical connector of FIG. 1 engaged to different circuit boards.

FIGS. 8-10 illustrate a top plan view, a front view, and a bottom plan view, respectively, of the electrical connector 100 engaged to the circuit boards 116 and 118. As described above, the connector housing 101 may include attachment structures 132 and 134 that facilitate securing the circuit board 118 to the connector housing 101 and also hold the circuit board 118 in a desired orientation. For instance, as shown in FIGS. 8 and 10, the circuit board 118 may be aligned with respect to the electrical connector 100 so that the alignment features 336 and 338 (FIG. 2) are received by recesses 376 and 378 in the board-edge section 272 of the circuit board 118. The board slots 320 and 322 (FIG. 2) may then receive portions of the circuit hoard 118. When the portions of the circuit board 118 are inserted into the board slots 320 and 322, the electrical connector 100 overlaps with board surfaces 274 and 276 as shown in FIGS. 8 and 10, respectively.

Also shown, the mounting features 332 and 334 are configured to be mounted onto the circuit board 118 and coupled thereto. The passages 333 and 335 (FIG. 2) of the mounting features 332 and 334, respectively, receive corresponding fasteners 342 and 344 (FIGS. 8 and 9), such as threaded fasteners, plugs, pins, and the like. In some embodiments, mounting nuts 346 and 348 (FIGS. 9 and 10) are secured to the fasteners 342 and 344. In such embodiments as those shown in FIGS. 8-10, the attachment structures 132 and 134 may be shaped to permit the mounting nuts 346 and 348 to be coupled to the fasteners 342 and 344 when proximate to the loading face 108. For instance, the mounting nuts 346 and 348 shown in FIG. 10 abut the loading face 108.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector configured to interconnect first and second circuit boards, the electrical connector comprising:

a connector housing having opposite mating and loading faces configured to engage board edges of the first and second circuit boards, respectively, the connector housing including a contact channel that extends through the connector housing between the mating and loading faces; and a signal contact stamped from sheet material along a stamped edge, the signal contact including a contact body having opposite sheet surfaces, the stamped edge defining a shape of the contact body that includes first and second contact fingers and a base portion that joins the first and second contact fingers, the first and second contact fingers extending lengthwise from the base portion in substantially opposite directions;

wherein the signal contact is disposed within the contact channel and held by the connector housing so that the stamped edge along the first contact finger is permitted to directly engage a contact pad of the first circuit board proximate to the mating face and so that the stamped edge along the second contact finger is permitted to directly engage a contact pad of the second circuit board proximate to the loading face.

2. The electrical connector in accordance with claim 1, wherein the sheet surfaces extend parallel to and define a body plane substantially throughout the contact body, the first and second contact fingers configured to flex within the body plane when the first and second contact fingers are deflected by the first and second circuit boards, respectively.

3. The electrical connector in accordance with claim 1, wherein the signal contact includes a plurality of signal contacts and the contact channel includes a plurality of contact channels, adjacent contact channels being separated by a sidewall, the sidewall having a wall thickness and the contact channels having corresponding channel spacings, the wall thickness being greater than the channel spacing.

4. The electrical connector in accordance with claim 1, wherein the first contact finger includes a leading end of the contact body and the second contact finger includes a trailing end of the contact body, the contact body having a length that extends between the leading and trailing ends, the contact channel the contact channel being sized and shaped to receive the leading end and permit the leading end to be advanced through the contact channel and positioned proximate to one of the mating or loading faces, the trailing end being positioned proximate to an other of the mating or loading faces.

5. The electrical connector in accordance with claim 1, wherein the signal contact includes a plurality of signal contacts and the contact channel includes a plurality of contact channels, the signal contacts forming a pair of opposing rows of signal contacts, the pair of opposing rows receiving the first circuit board between the first contact fingers and the second circuit board between the second contact fingers.

6. The electrical connector in accordance with claim 1, wherein the first and second contact fingers flex with respect to the base portion when deflected by the first and second circuit boards.

7. The electrical connector in accordance with claim 6, wherein the first and second contact fingers flex in a common direction when engaged-deflected by the first and second circuit boards, respectively.

8. The electrical connector in accordance with claim 6, wherein the base portion comprises first and second arms joined at a center region, the first and second contact fingers extending from the first and second arms, respectively, the first and second arms extending substantially parallel to each other and having a spacing therebetween.

9. The electrical connector in accordance with claim 6, wherein the base portion and the contact channel of the connector housing are shaped to form an interference fit when the signal contact is inserted into the contact channel.

10. The electrical connector in accordance with claim 1, wherein the connector housing comprises a single body formed from an insulative material.

11. The electrical connector in accordance with claim 1, wherein the connector housing is shaped to facilitate holding the first and second circuit boards in a substantially co-planar relationship.

12. The electrical connector in accordance with claim 1 further comprising power contacts extending through the connector housing and configured to electrically engage the first and second circuit boards, wherein the power contacts and the signal contacts are sized and shaped differently, the power contacts being sized and shaped to transmit at least about 6 amperes and the signal contacts being sized and shaped to transmit at least about 10 gigabits/second.

13. An electrical connector configured to interconnect first and second circuit boards, the connector comprising:

a connector housing having opposite mating and loading faces configured to engage board edges of the first and second circuit boards, respectively, the connector housing including a contact channel that extends through the connector housing between the mating and loading faces; and a signal contact stamped from sheet material, the signal contact including a contact body having opposite sheet surfaces and a stamped edge extending therebetween, the opposite sheet surfaces extending parallel to and defining a body plane substantially throughout the contact body, the contact body including a base portion and first and second contact fingers that extend lengthwise from the base portion in substantially opposite directions;

wherein the connector housing is configured to hold the base portion within the contact channel, the first and second contact fingers flexing relative to the base portion and within the body plane when the first and second contact fingers directly engage and are deflected by the first and second circuit boards, respectively.

14. The electrical connector in accordance with claim 13, wherein the first and second contact fingers flex in a common direction when engaged by the first and second circuit boards, respectively.

15. The electrical connector in accordance with claim 13, wherein the stamped edge along the first contact finger is permitted to directly engage a contact pad of the first circuit board proximate to the mating face and the stamped edge along the second contact finger is permitted to directly engage a contact pad of the second circuit board proximate to the loading face.

16. The electrical connector in accordance with claim 13, wherein the base portion comprises first and second arms joined at a center region, the first and second contact fingers extending from the first and second arms, respectively, the first and second arms extending substantially parallel to each other and having a spacing therebetween.

17. The electrical connector in accordance with claim 13, wherein the base portion and the contact channel of the connector housing are shaped to form an interference fit when the signal contact is inserted into the contact channel.

18. The electrical connector in accordance with claim 13, wherein the connector housing comprises a single body formed from an insulative material.

19. The electrical connector in accordance with claim 18 further comprising a power contact extending through the connector housing and configured to electrically engage the first and second circuit boards, the power contact being coupled cold-staked to couple the power contact to the connector housing through a cold staking process.

20. The electrical connector in accordance with claim 13, wherein the connector housing is shaped to facilitate holding the first and second circuit boards in a substantially co-planar relationship.

* * * * *